US006450508B1

(12) United States Patent
Chu

(10) Patent No.: US 6,450,508 B1
(45) Date of Patent: Sep. 17, 2002

(54) SHOE FOR SKATING AND WALKING

(76) Inventor: Wei-Yen Chu, No. 261, Ta Chu Road, Lu Chu Hsiang, TaoYuan Hsien (TW)

( * ) Notice: Subject to any disclaimer, the term of this patent is extended or adjusted under 35 U.S.C. 154(b) by 0 days.

(21) Appl. No.: 09/796,510

(22) Filed: Mar. 2, 2001

(51) Int. Cl.[7] ..... A63C 17/14; A63C 17/26

(52) U.S. Cl. ..... 280/11.208; 280/11.223; 280/11.233; 280/11.27

(58) Field of Search ..... 280/7.12, 7.13, 280/7.14, 9, 11.19, 11.204, 11.208, 11.211, 11.212, 11.223, 11.233, 11.26, 11.27, 11.28, 825

(56) References Cited

U.S. PATENT DOCUMENTS 3,351,353 A * 11/1967 Weitzner ..... 280/7.13
4,333,249 A * 6/1982 Schaefer ..... 280/11.19
5,335,924 A * 8/1994 Richards, Sr. et al. .. 280/11.211
5,882,018 A * 3/1999 Petrosino ..... 280/7.13
5,918,889 A * 7/1999 Tai ..... 280/11.28
6,042,125 A * 3/2000 Wu ..... 280/11.27
6,086,072 A * 7/2000 Prus ..... 280/11.28
6,120,039 A * 9/2000 Clementi ..... 280/11.19
6,328,318 B1 * 12/2001 Hsu ..... 280/11.223

FOREIGN PATENT DOCUMENTS

DE 197 55 340 A1 * 6/1999 ..... A63C/17/14
JP 9-290040 * 11/1997 ..... A63C/17/14

* cited by examiner

*Primary Examiner*—Frank Vanaman
(74) *Attorney, Agent, or Firm*—Rosenberg, Klein & Lee

(57) ABSTRACT

A shoe for walking and skating having a shoe, a locating plate, two locating members, two rollers and a brake. The shoe has a sole provided with front and rear holding grooves. The bottom of the locating plate includes front and rear locating frames respectively corresponding to the front and rear holding grooves. The locating members are respectively fixed in the front and the rear locating frames. Each of the locating members has a button on opposing sides for pushing a pivoting element to control the axial movement of a locating pin while a cap is used to fix the button, the pivoting element and the locating pin. In addition, a compression spring is interposed between the cap and the locating pin. Further, a mounting bar with an elongated groove moves up and down and is mounted on either side of the locating members. The rollers are mounted on the elongated grooves of the mounting bars. Upper and lower locating holes are disposed at both sides thereof so that the locating pin can be inserted into either locating hole for fixing the rollers in place. The brake has a locating housing, a locating rod assembly and a braking piece. The locating housing together with the rear locating member is arranged in the rear locating frame. The braking piece outwardly projects or is hidden inside by use of the locating rod assembly together with an upper and a lower fixing hole.

7 Claims, 11 Drawing Sheets

SHOE FOR SKATING AND WALKING

BACKGROUND OF THE INVENTION

1. Field of the Invention

The present invention relates to a shoe for walking and skating whose sole can be kept clean, is more convenient, and safer to use.

2. Description of the Prior Art

In order to increase the efficiency of shoes, many shoes previously disclosed contain a sole that cannot remain clean which causes malfunctioning of the rollers as illustrated in TW Pat. No. 367879 (see FIG. 1) and TW Pat. No. 400753. In these two disclosures, a conventional shoe is provided with rollers 7 on the sole in a projecting or hidden mode, thereby creating the skating functional character of a shoe. However, the bottom of the holding groove 8 has to be open in order to store the rollers 7, wherein impurities accumulate, which may cause the rollers to malfunction (i.e., the rollers are easily blocked by the impurities). Moreover, the pivot 71 of the rollers 7 contains a strong spring (not shown) so that the stored rollers will not fall. However, it takes a lot of effort to bring out the rollers in place for skating, and it generally is impossible for children to put the rollers in place. Also, since no braking device is present, safety is not ensured.

SUMMARY OF THE INVENTION

It is a primary object of the present invention to provide a shoe for walking and skating in which the sole can be kept clean for preventing the rollers from malfunctions.

It is another object of the present invention to provide a shoe for walking and skating containing a braking element for ensuring safety.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
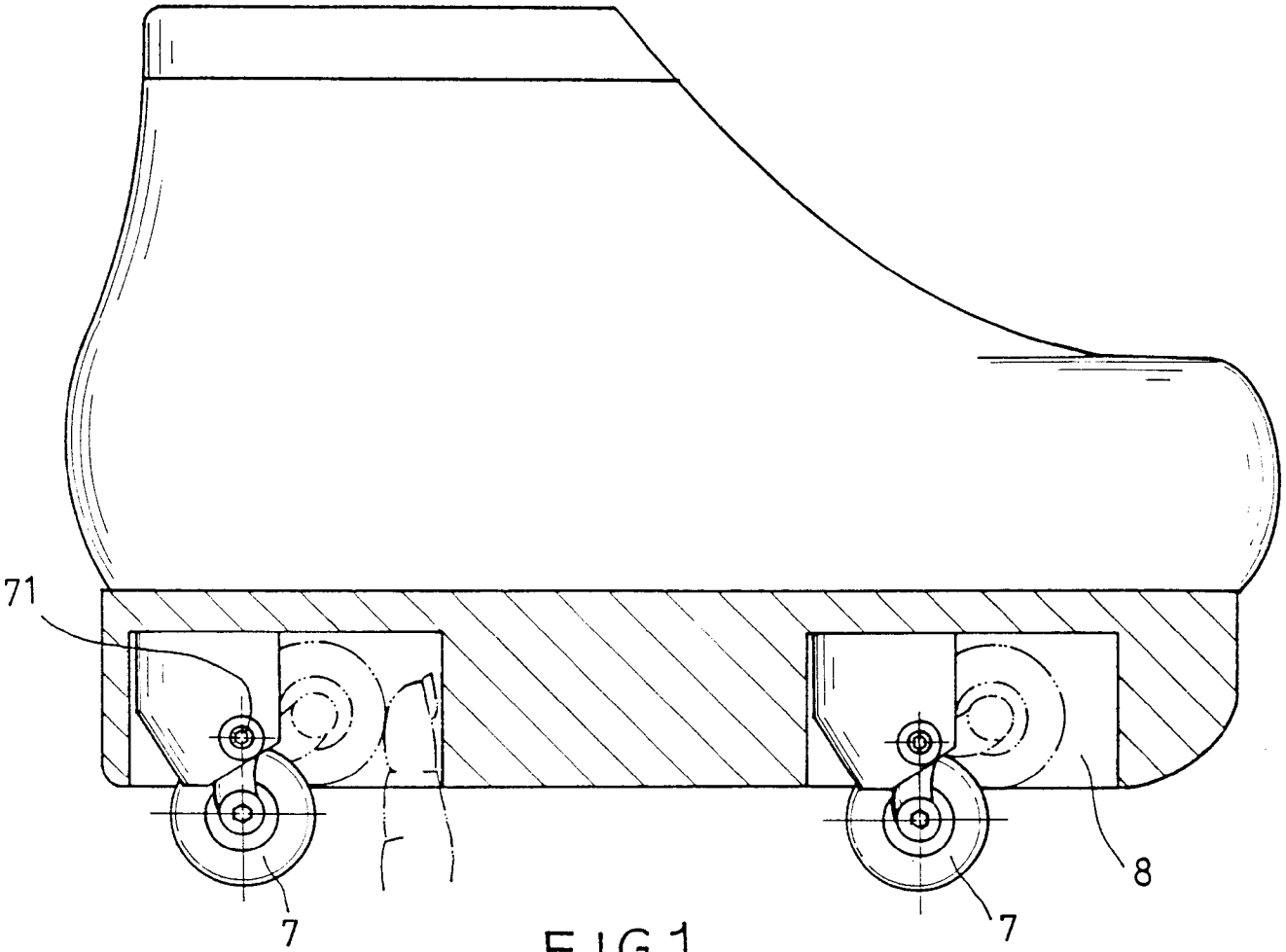
FIG.1 PRIOR ART
FIG. 1 is a schematic drawing of a conventional shoe with rollers.
Figure 2:
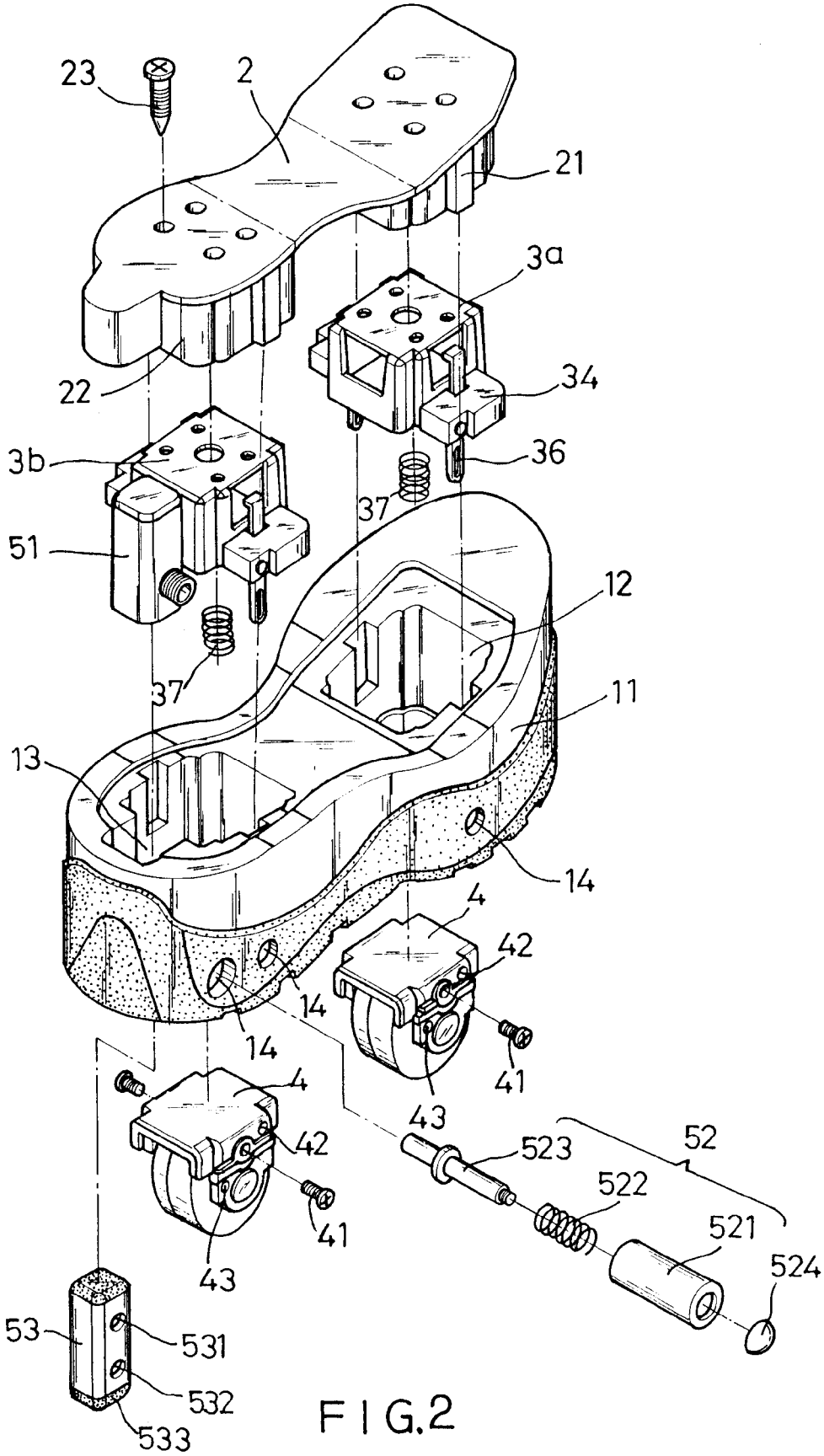
FIG. 2 is a perspective exploded view of an embodiment of the present invention.
Figure 3:
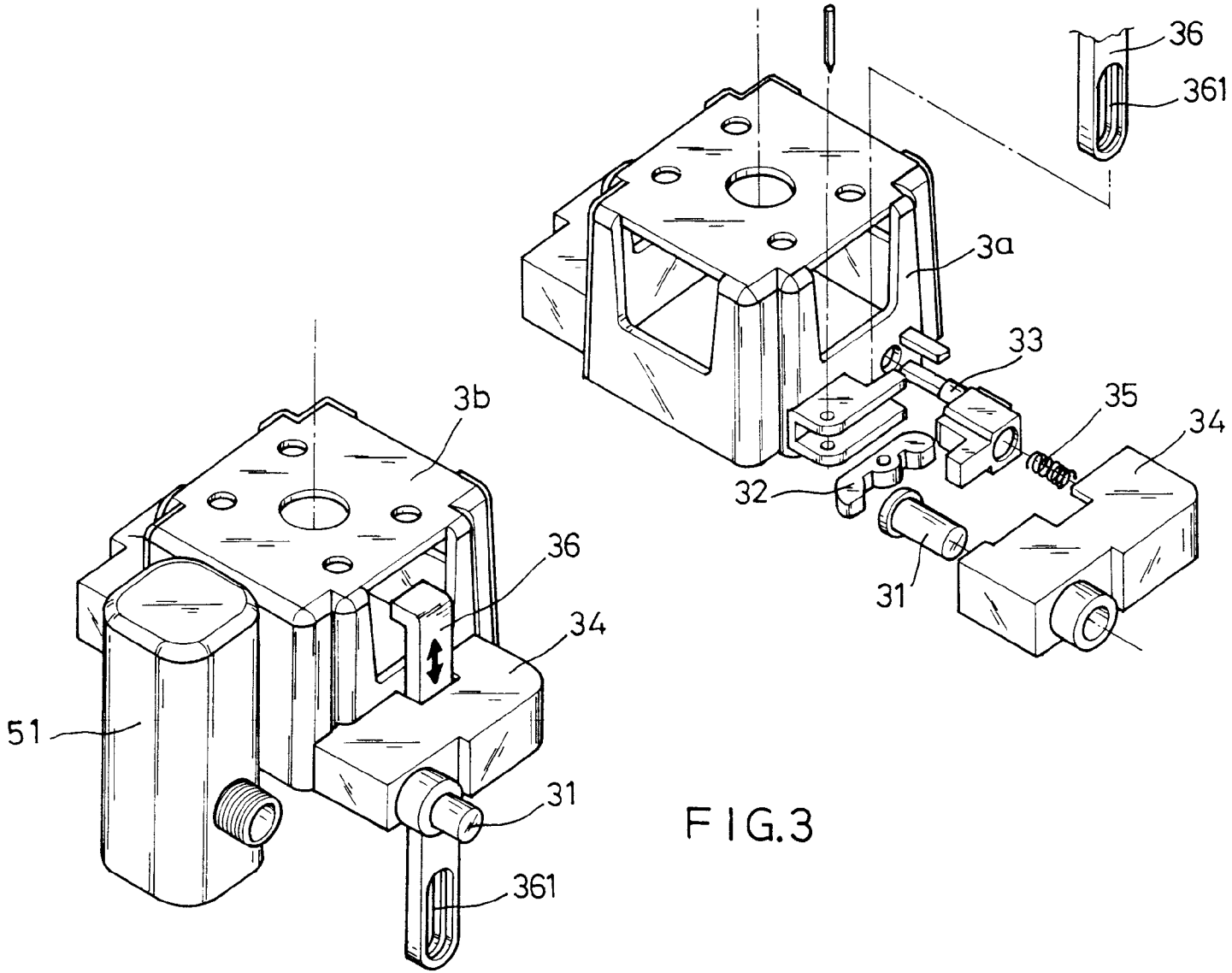
FIG. 3 is a perspective view of the locating members of the embodiment of the present invention.

First of all, referring to FIGS. 2 through 6, the shoe for walking and skating in accordance with the present invention includes a shoe 1, a locating plate 2, two locating members 3*a*, 3*b*, two rollers 4 and a brake 5. The shoe 1 has a sole 11 provided with a front and a rear holding grooves 12, 13. The bottom of the locating plate 2 includes a front and a rear locating frames 21, 22 respectively corresponding to the front and rear holding grooves 12, 13.

The locating members 3*a*, 3*b* are respectively fixed in the front and the rear locating frames 21, 22 by means of screws 23. Each of the locating members 3*a*, 3*b* has a button 31 at either side thereof for pushing a pivoting element 32 to control the axial movement of a locating pin 33 while a cap 34 is used to fix the button 31, the pivoting element 32 and the locating pin 33. Additionally, a compression spring 35 is interposed between the cap 34 and the locating pin 33, thereby creating a resilient force required by the locating pin 33 in returning to its original position. Moreover, a mounting bar 36 with an elongated groove 361 moves up and down and is mounted on either side of the locating members 3*a*, 3*b*.

The rollers 4 are mounted on the elongated grooves 361 of the mounting bars 36 by means of screws 41. In addifion, upper and lower locating holes 42, 43 are disposed at both sides thereof so that the locating pin 33 can be inserted into either of locating holes 42, 43 for fixing the rollers 4 in place.

The brake 5 has a locating housing 51, a locating rod assembly 52 and a braking piece 53. The locating housing 51 together with the rear locating member 3*b* is arranged in the rear locating frame 22. The braking piece 53 outwardly projects or is hidden inside by means of the locating rod assembly 52 together with an upper and a lower fixing hole 531, 532.

The sole 11 is provided with a plurality of through holes 14 at positions corresponding to each of the buttons 31 and the locating rod assembly 52.

In addition, the braking piece 53 serving as a contact body 533 with the ground is made of a high-abrasive plastic material.

Moreover, a compression spring 37, 54 is respectively arranged in the locating members 3*a*, 3*b* and the locating housing 51 of the brake 5.

Furthermore, the locating rod assembly 52 is composed of a sleeve 521, a spring 522 and a fixing pin 523. The spring 522 fitted to the inside of the sleeve 521 supports against the fixing pin 523, and a domed head 524 is mounted on the outer end of the fixing pin 523 for pulling.

Figure 4:
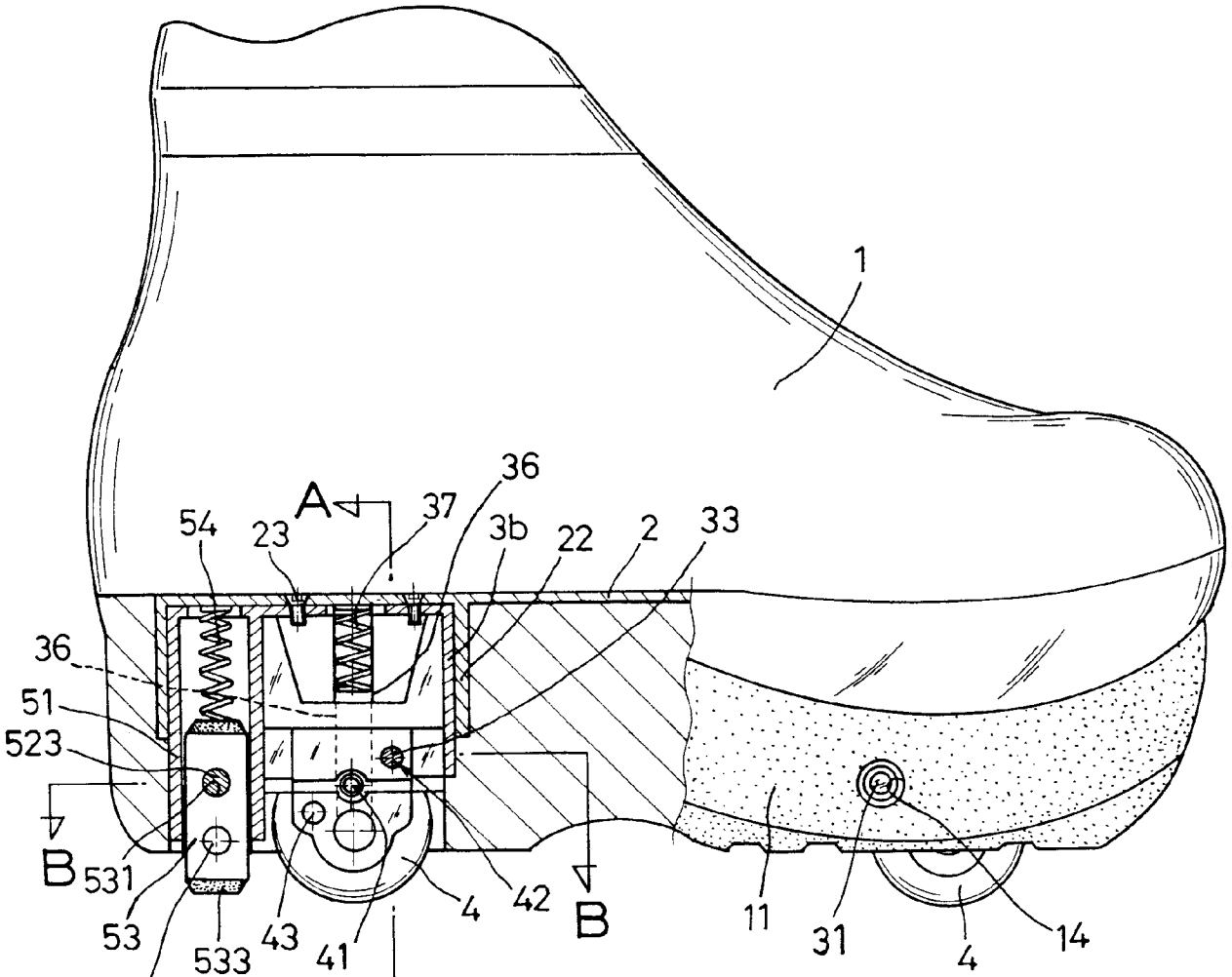
FIG. 4 is a partially sectional view of the embodiment of the present invention in skating mode.
Figure 5:
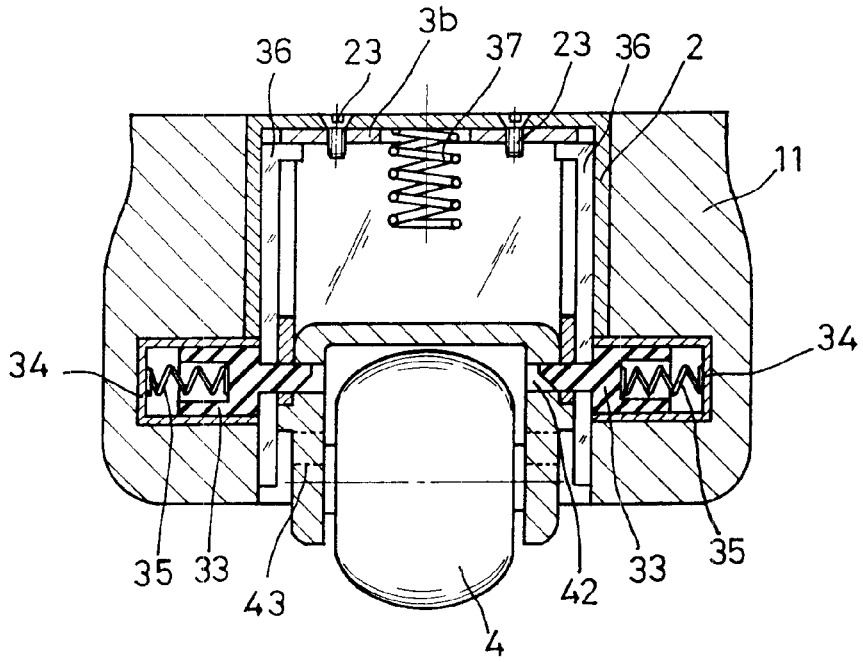
FIG. 5 is a sectional view taken from the line A—A of FIG. 4.
Figure 6:
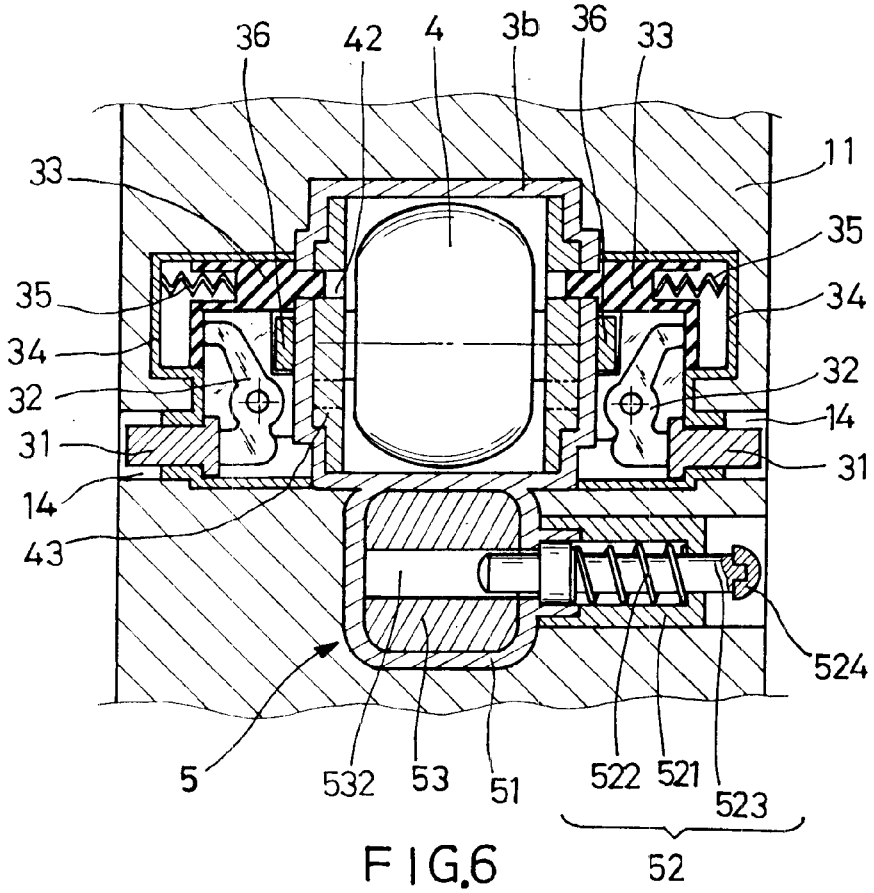
FIG. 6 is a sectional view taken from the line B—B of FIG. 4 (in locked state)
Figure 7:
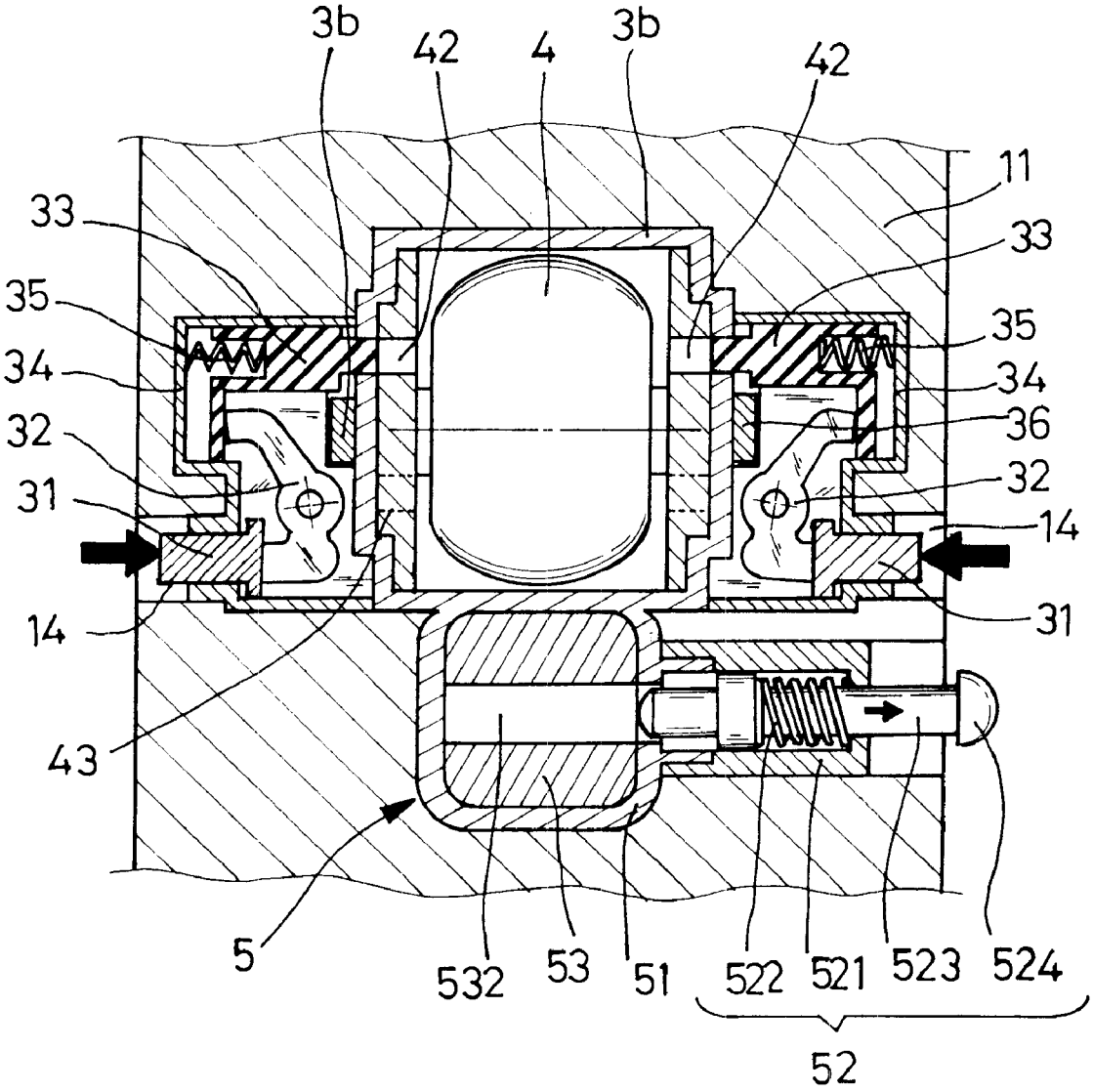
FIG. 7 is a sectional view taken from the line B—B of FIG. 4 (in released state)

Referring to FIG. 4, the rollers 4 and the braking piece 53 are located for a skating mode. At this time, the rollers 4 are directed downwardly and the braking piece 53 projected outwardly. With reference to FIGS. 5 and 6, the rollers 4 are located by means that the locating pin 33 is inserted into the upper locating hole 42 while the braking piece 53 is located by means that the fixing pin 523 of the locating rod assembly 52 is inserted through the upper fixing hole 531. As shown in FIG. 7, in changing the locating mode of the rollers 4 and the braking piece 53, the button 31 is pressed down to retract the locating pin 33 by means of the pivoting element 32, thereby creating a releasing state. Meanwhile, the fixing pin 523 of the locating rod assembly 52 is pulled outwardly to release the braking piece 53.

Figure 8:
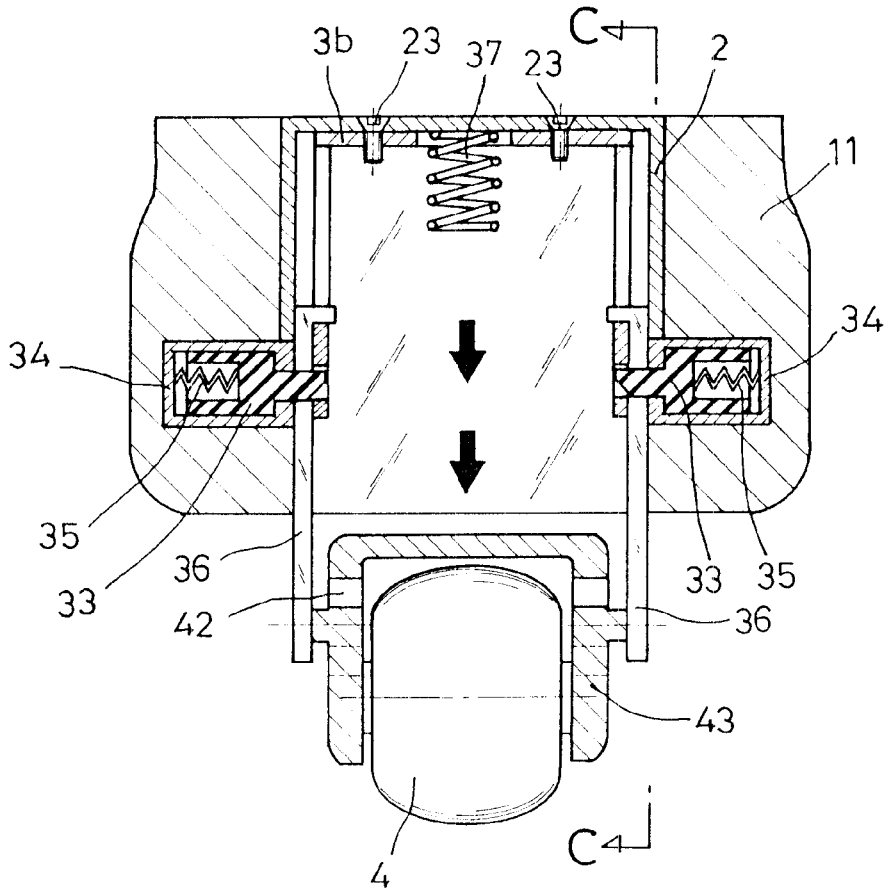
FIG. 8 is a schematic drawing of the first step in hiding the rollers of the present invention.
Figure 9:
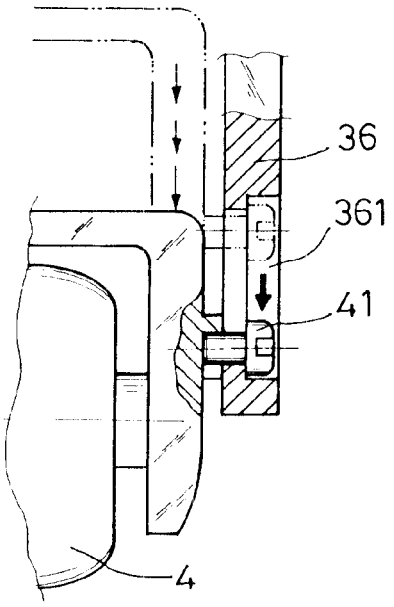
FIG. 9 is a sectional view taken from the line C—C of FIG. 8.
Figure 10:
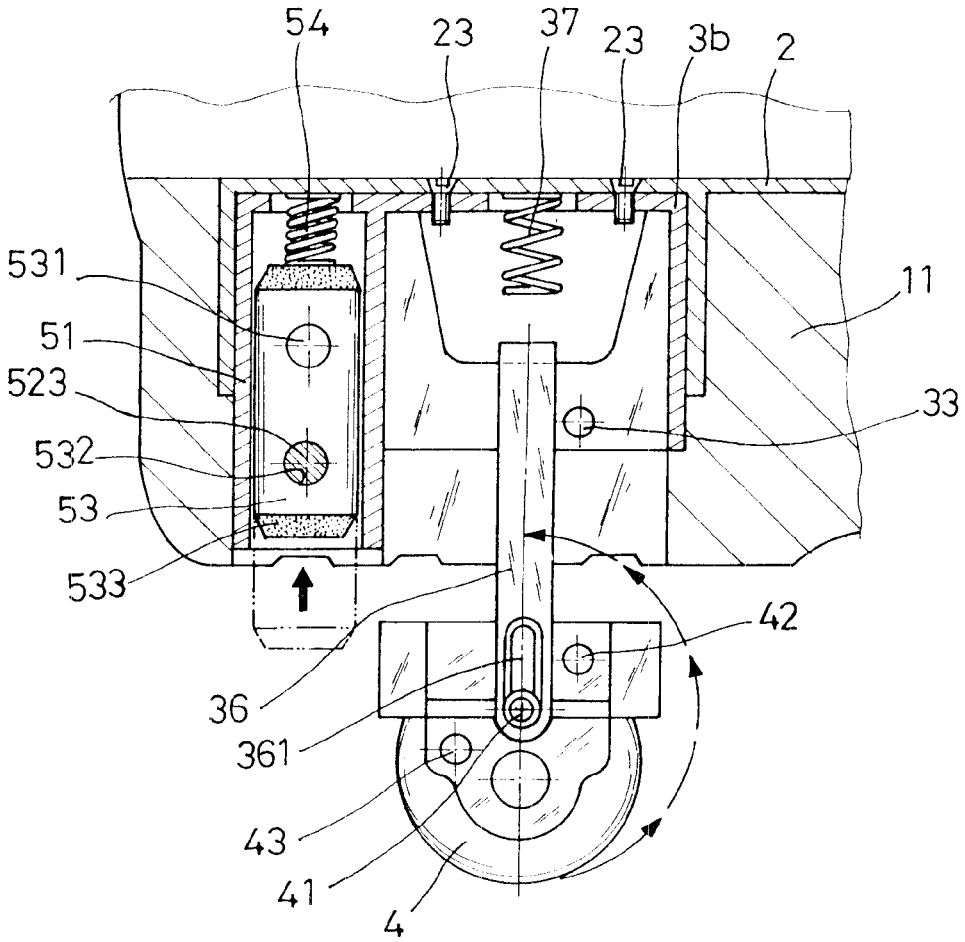
FIG. 10 is a schematic drawing of the second step in hiding the rollers of the present invention.
Figure 11:
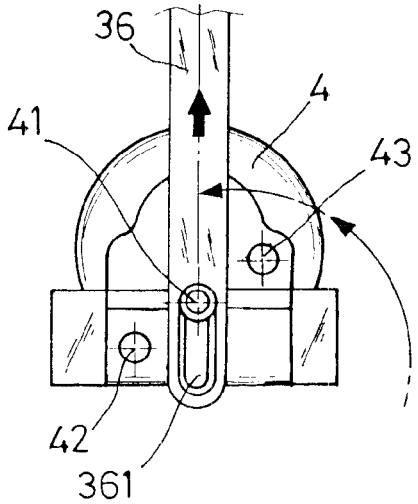
FIG. 11 is a schematic drawing of the third step in hiding the rollers of the present invention.
Figure 12:
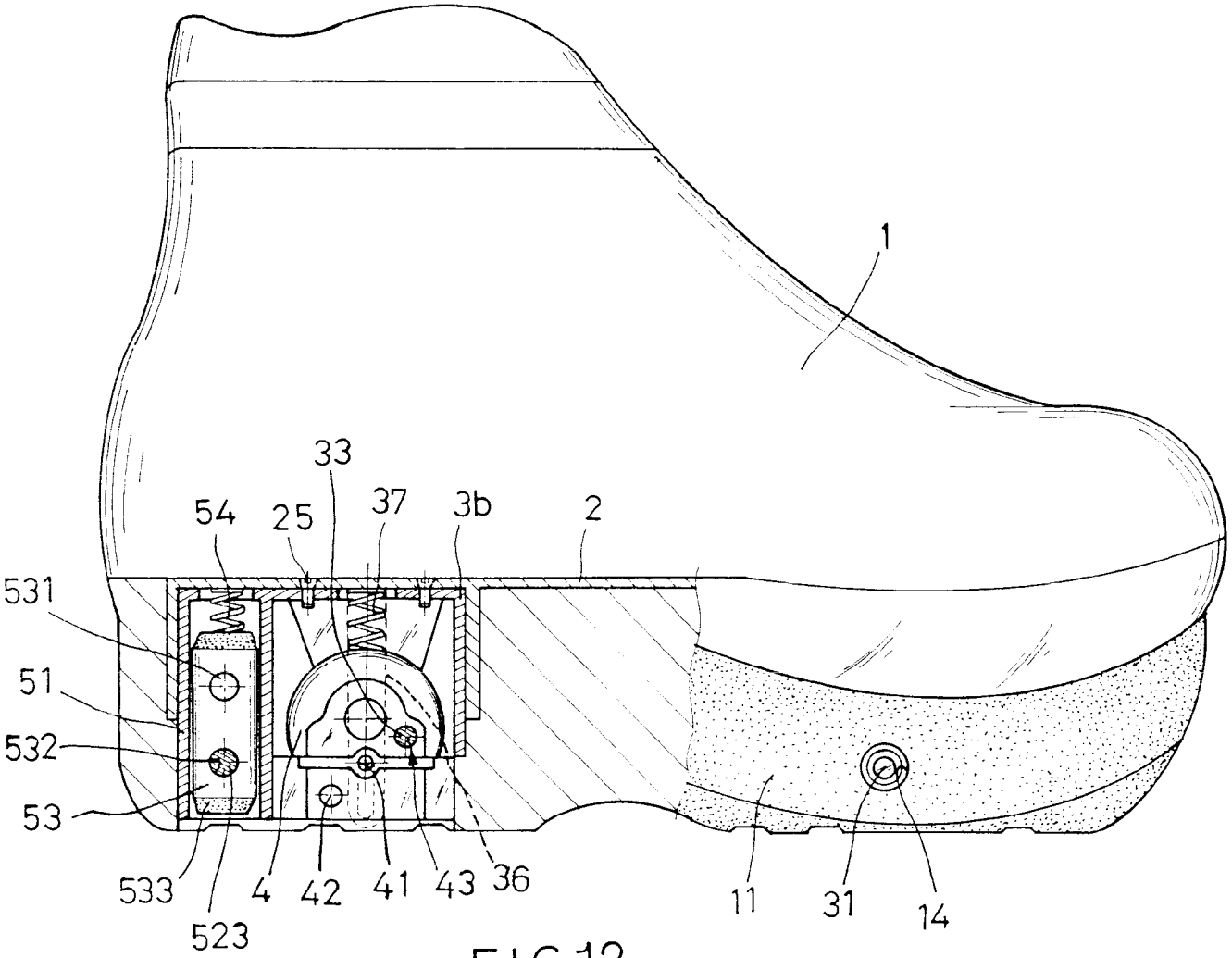
FIG. 12 is a partially sectional view of the embodiment of the present invention in walking mode.
Figure 13:
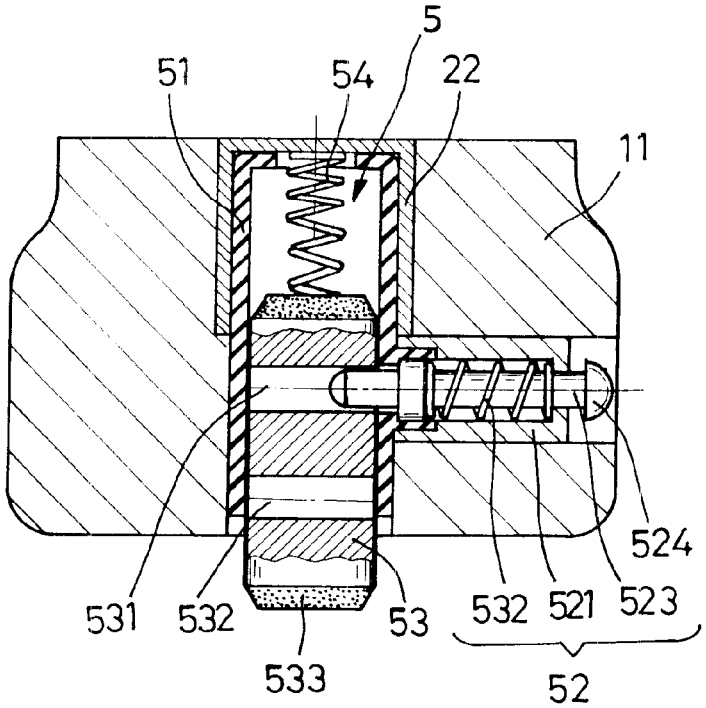
FIG. 13 is a schematic drawing of a braking piece in an exposed (projecting) state.
Figure 14:
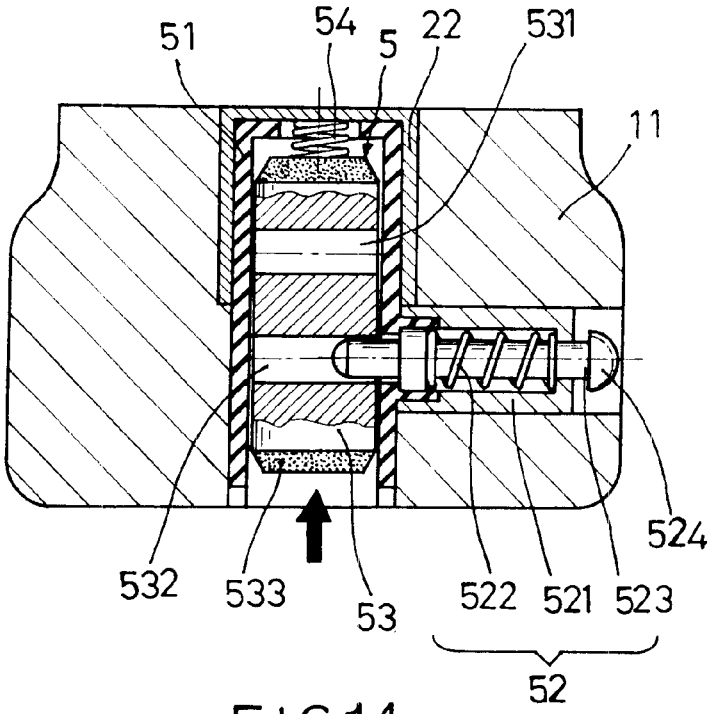
FIG. 14 is a schematic drawing of the braking piece in a hidden state.

Thereafter, as shown in FIGS. 8 and 9, when the rollers 4 are released, they will fall down along the elongated grove 361 of the mounting bar 36 (while the mounting bar 36 also falls down) so that the rollers 4, as shown in FIGS. 10 and 11, have the revolving space. After the rollers 4 are revolved, as shown in FIG. 12, the locating pin 33 restores itself by means of the resilient force of the spring 35 in a locked state. Meanwhile, the locating pin 33 is inserted into the lower locating hole 43 to hide the rollers 4 in place. Additionally, the fixing pin 523 of the braking piece 53 also restores itself by means of the resilient force of the spring 522 in a locked state. Meanwhile, the fixing pin 523 is inserted into the lower fixing hole 532 to hide the braking piece 53 in place, as shown in FIGS. 13 and 14. Accordingly, a walking function is created. The rollers 4 and the braking piece 53 can be changed from the hidden state to the exposed state in a similar method as described above.

Figure 15:
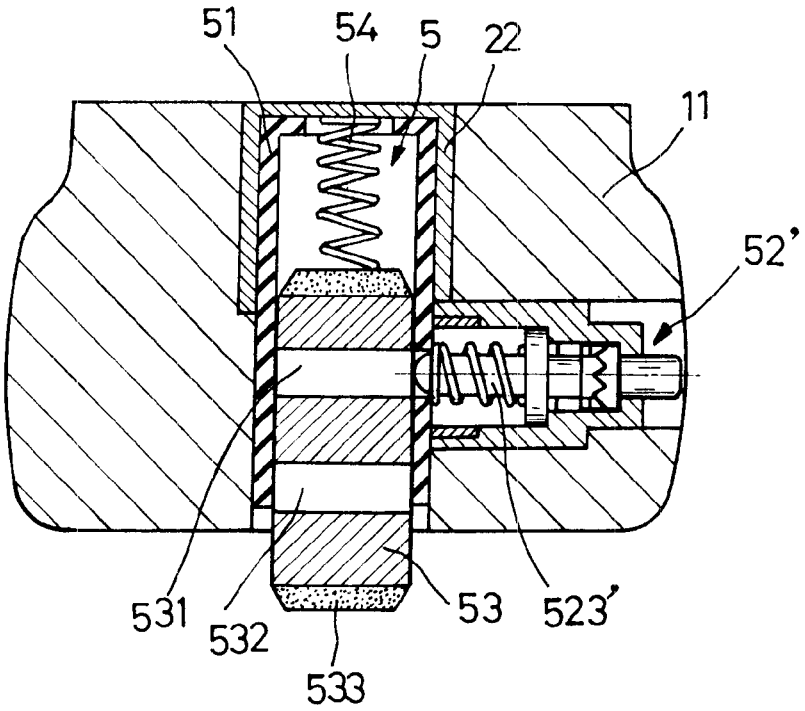
FIG. 15 is a first schematic drawing of another embodiment of a locating rod assembly of the present invention.
Figure 16:
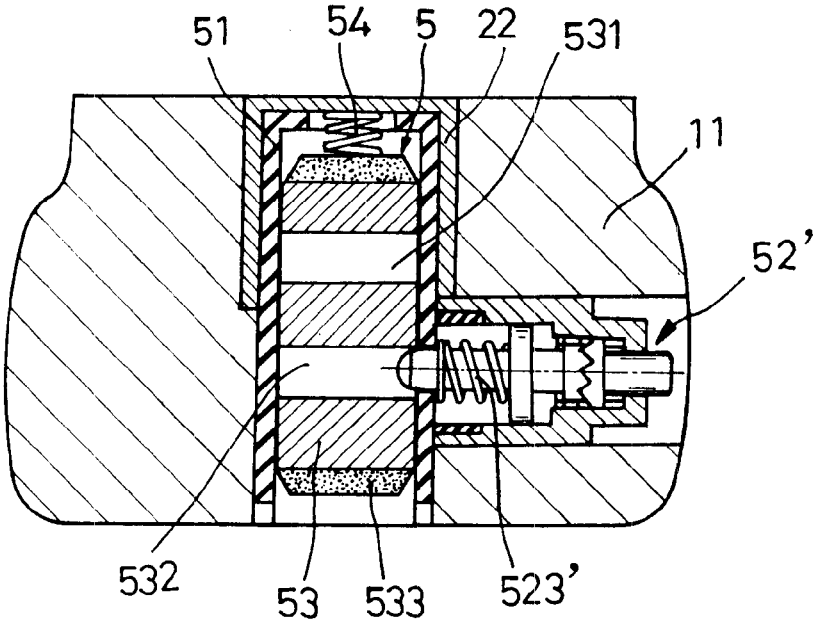
FIG. 16 is a second schematic drawing of another embodiment of the locating rod assembly of the present invention.

As shown in FIGS. 15 and 16, another embodiment of the locating rod assembly 52' is formed as a press switch, and the fixing pin 523' is telescopic to locating the braking piece 53 in place. The arrangement position of the braking piece 53 is both fixable and adjustable.

Whether performing the skating or the walking functions, the front and rear holding grooves 12, 31 of the sole 11 are sealed by the top rim of the rollers 4, thereby preventing the foreign bodies from entering into the front and rear holding grooves 12, 13 so that the front and rear holding grooves 12, 13 remain clean. In addition, the rollers 4 avoid impurifies and malfunctioning. Further, the braking piece 53 is included to secure safety when in use. Moreover, it is only required to press the button 31 to push the pivoting element 32 for an axial movement of the locating pin 33, thereby releasing the locating pin 33 from the upper or the lower locating holes 42, 43. Thereafter, the rollers 4 are revolving to change position. Simultaneously, the position of the braking piece 53 can also be adjusted by the locating rod assembly 52. Again, when the rollers 4 and the braking piece 53 are received in the holding grooves 12, 13 and the locating housing 51, they can be smoothly removed by the compressed spring 37, 54 without the conventional blocking problems. Thus, it's very convenient to change the locating direction of both rollers 4. The locating position of the braking piece 53 and also be changed by the locating rod assembly 52. Therefore, the present invention is convenient in use.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A shoe for walking and skating, comprising:

a shoe having a sole formed therein provided with front and rear holding grooves;

a locating plate having front and rear locating frames extending from bottom surface thereof, said front and rear locating frames respectively corresponding to said front and rear holding grooves for insertion thereof;

a pair of locating members defining a rear locating member and a front locating member; each having a mounting bar movable within elongated grooves formed within each of said locating members, each of said locating members being respectively fixedly secured to said front and rear locating frames, each of said locating members having a button projecting therefrom, said button fixed to said locating member by a cap and selectively engaging a pivoting element to control axial movement of a locating pin, a compression spring positioned between said cap and said locating pin for biasing said locating pin;

a pair of rollers respectively inserted into said elongated grooves of said mounting bars, each of said rollers having upper and lower locating holes formed therethrough, said locating pin being selectively inserted into said upper or said lower locating holes fixedly capturing said rollers; and a brake having a locating housing, a locating rod assembly and a braking piece, said locating housing fixedly secured to said rear locating member in said rear locating frame, said locating rod assembly having a fixing pin, a compression spring, a sleeve and a domed head, said braking piece having upper and lower fixing holes and fixedly secured to said locating housing by said locating rod assembly, said braking piece projecting outwardly from said locating housing to contact a ground surface when said shoe is inclined.

2. The shoe for walking and skating as claimed in claim 1, wherein said button is pressed to retract said locating pin by means of said pivoting element while said fixing pin of said locating rod assembly is pulled outwardly to release the braking piece for providing a walking shoe.

3. The shoe for walking and skating as claimed in claim 1, wherein said sole contains a plurality of through holes at positions corresponding to each of said buttons and said locating rod assembly.

4. The shoe for walking and skating as recited in claim 1, wherein said braking piece consists of a high-abrasive plastic material for serving as a contact body with the ground.

5. The shoe for walking and skating as recited in claim 1, wherein a plurality of compression springs are respectively arranged in each of said locating members and said locating housing of said brake.

6. The shoe for walking and skating as recited in claim 1, wherein said spring is contained within the interior of said sleeve to support said fixing pin.

7. The shoe for walking and skating as recited in claim 1, wherein said locating rod assembly forms a press switch for coupling and decoupling of said braking piece from said locating housing.

* * * * *